United States Patent [19]

Yoshimatsu

[11] Patent Number: 5,062,266

[45] Date of Patent: Nov. 5, 1991

[54] SLEWING CONTROL DEVICE FOR CRANE

[75] Inventor: Hideaki Yoshimatsu, Akashi, Japan

[73] Assignee: Kabushiki Kaisha Kobe Seiko Sho, Kobe, Japan

[21] Appl. No.: 571,108

[22] Filed: Aug. 23, 1990

[51] Int. Cl.[5] ..... F15B 11/04

[52] U.S. Cl. ..... 60/466; 60/468; 60/493; 60/494

[58] Field of Search ..... 60/460, 461, 464, 466, 60/468, 493, 494

[56] References Cited

U.S. PATENT DOCUMENTS

| | | | |
|---|---|---|---|
| 4,520,625 | 6/1985 | Sato et al. | 60/494 X |
| 4,586,332 | 5/1986 | Schexnayder | 60/468 |
| 4,845,948 | 7/1989 | Tha et al. | 60/460 X |

FOREIGN PATENT DOCUMENTS

| | | |
|---|---|---|
| 20319 | 5/1985 | Japan . |
| 229029 | 10/1986 | Japan . |

*Primary Examiner*—Edward K. Look
*Assistant Examiner*—George Kapsalas
*Attorney, Agent, or Firm*—Oblon, Spivak, McClelland, Maier & Neustadt

[57] ABSTRACT

A slewing control device for a crane for supplying a discharge oil from a pump through a direction selecting valve to a slewing motor and for controlling a rotational direction of the slewing motor. The device includes a selector provided in a main circuit between the pump and the direction selecting valve for selecting either an unload condition of the pump where a hydraulic oil in the main circuit is communicated with a tank or an on-load condition of the pump where the communication from the main circuit to the tank is blocked. A controller outputs a select signal to the selector to select the unload condition in response to detecting a dangerous operating condition. The controller also outputs a pressure control signal to an electromagnetic proportional pressure control valve provided between the direction selecting valve and a discharge port of the slewing motor to control oil pressure on a discharge side of the slewing motor when slewing needs to be stopped. Accordingly, the motor can be automatically braked to rapidly brake a slewing body of the crane.

2 Claims, 3 Drawing Sheets

SLEWING CONTROL DEVICE FOR CRANE

BACKGROUND OF THE INVENTION

1. Field of the Invention

The present invention relates to a slewing control device for a crane.

2. Discussion of the Background

In a crane such as a hydraulic truck crane having a slewing body mounted on a vehicle body and a multi-stage telescopic boom derrickably supported to the slewing body, a hoisting capacity of the crane varies with operational conditions such as a hoisting load, boom length, boom derricking angle, outrigger expanded condition, slewing angle and slewing speed. For example, when all of four outriggers of the truck crane are expanded at the maximum, the hoisting capacity can be desirably increased. However, when an expansion length of one or more of the outrigger is reduced according to a surrounding condition, the hoisting capacity in a slewing area corresponding to the reduced expansion length is reduced. Accordingly, it is necessary to limit a slewing range according to an expanded condition of each outrigger. Further, it is necessary to limit the slewing range so as to prevent a suspended load or the boom from contacting surrounding obstacles such as buildings. In this circumstance, it is desirable that slewing of the slewing body can be automatically stopped as required such as before the slewing body reaches a dangerous area where the hoisting capacity is low.

Conventionally, it is known from Japanese Patent Publication No. 60-20319, for example, that automatic stop of slewing is effected by setting a safe area and a dangerous area of slewing, outputting an automatic stop signal before the slewing reaches the dangerous area, and selecting an operational position of an electromagnetic closing valve by the signal to communicate a vent circuit of a main relief valve provided between a pump and a slewing direction selecting valve to a tank and thereby unload a discharge oil from the pump to the tank.

In the above conventional device, when the automatic stop signal is input into the electromagnetic closing valve during the slewing, the discharge oil from the pump is unloaded to the tank. Accordingly, a pressure (accelerating pressure) on a suction side of a slewing motor can be made substantially zero. However, a pressure (decelerating pressure) on a discharge side of the slewing motor cannot be controlled. For this reason, if an operational position of the direction selecting valve is maintained at a slewing position, the slewing motor cannot be positively stopped but the slewing body continues to be rotated by inertia regardless of unloading the pump. Accordingly, it is necessary to select the operational position of the direction selecting valve from the slewing position to a neutral block position, so as to positively stop the slewing body. If such a select operation is delayed, there is a danger that the slewing body will reach the dangerous area.

Meanwhile, a slewing control system is classified into a neutral brake system wherein when the operational position of the direction selecting valve is returned to the neutral position, circuits on opposite sides of the slewing motor are blocked to stop the slewing and a neutral free system wherein when the operational position of the direction selecting valve is returned to the neutral position, the circuits on the opposite sides of the motor are communicated with each other to inertially rotate the motor (inertial slewing operation). Either the neutral brake system or the neutral free system is adopted according to the type of working. For example, the neutral brake system is desirable for normal crane working and high-altitude working, while the neutral free system is desirable for harbor cargo operation. Further, in general, the neutral brake system is often used in a wheel-type crane, while the neutral free system is often used in a crawler-type crane.

The above-mentioned conventional device is applied to the neutral brake system. If this conventional device is applied to the neutral free system, it is necessary to operate the direction selecting valve in a direction counter to that upon slewing, which is called a counter lever operation, in order to stop the slewing. Therefore, the effect of the device cannot be sufficiently exhibited.

SUMMARY OF THE INVENTION

It is accordingly an object of the present invention to provide a slewing control device for a crane which can automatically rapidly stop a slewing body even when the operational position of the direction selecting valve is in the slewing position in the case where the need of stopping the slewing is generated during the slewing operation.

It is another object of the present invention to provide a slewing control device for a crane which permits an operator to interrupt the automatic stop control and preferentially effect a manual control for emergency stop, thereby improving the safety.

It is a further object of the present invention to provide a slewing control device for a crane which can be effectively applied to both the neutral brake system and the neutral free system.

According to the present invention, there is provided in a slewing control device for a crane for supplying a discharge oil from a pump through a direction selecting valve to a slewing motor and controlling a rotational direction of said slewing motor; the improvement comprising select means provided in a main circuit between said pump and said direction selecting valve for selecting either an unload condition of said pump where a hydraulic oil in said main circuit is communicated with a tank or an on-load condition of said pump where the communication from said main circuit to said tank is blocked; first and second check valves provided between said direction selecting valve and a suction port of said slewing motor and between said direction selecting valve and a discharge port of said slewing motor, respectively, for permitting flow of said hydraulic oil from said direction selecting valve to said slewing motor; first and second electromagnetic proportional pressure control valves provided between said direction selecting valve and said suction port of said slewing motor and between said direction selecting valve and said discharge port of said slewing motor in parallel to said first and second check valves, respectively, for controlling pressure of a discharge oil from said slewing motor to said direction selecting valve; and control means for outputting a select signal to said select means to select said unload condition and also outputting a pressure control signal to said second electromagnetic proportional pressure control valve provided between said direction selecting valve and said discharge port of said slewing motor to control oil pressure on a discharge side of said slewing motor when slewing needs to be stopped.

With this construction, when the need of stopping the slewing is generated during the slewing operation, the slewing can be automatically rapidly stopped even when the operational position of the direction selecting valve is in the slewing position by controlling the oil pressure on the discharge side of the motor by the signal from the control means. Further, even under the automatic stop control, the operator can interrupt the automatic stop control to preferentially effect a manual control for emergency stop, thus improving the safety. Further, the device of the present invention can be applied to both the neutral brake system and the neutral free system, and the automatic stop of slewing can be effected in both the systems, thus improving a general-purpose performance of the device.

According to a preferred form of the present invention having the above construction, the slewing control device further comprises a back pressure valve provided in an oil return circuit from said direction selecting valve to said tank, wherein a cracking pressure of said back pressure valve is set to a value higher than a minimum set pressure of said electromagnetic proportional pressure control valves.

With this construction, in the case of an inertial slewing operation wherein the direction selecting valve is returned to a neutral position to rotate the slewing body by inertia according to the neutral free system, an undue brake pressure due to a low pressure difference between the discharge side and the suction side of the motor is prevented from being applied to the motor, thereby smoothly effecting the inertial slewing operation.

Other objects and features of the invention will be more fully understood from the following detailed description and appended claims when taken with the accompanying drawings.

DETAILED DESCRIPTION OF THE PREFERRED EMBODIMENTS

The device of the present invention is effectively applicable to both the neutral brake system and the neutral free system. Accordingly, the following description of the present invention is directed, for the convenience of explanation, to a preferred embodiment applied to a circuit which can selectively employ both the neutral brake system and the neutral free system. A basic construction of such a selectable circuit is substantially the same as that disclosed in Japanese Patent Application No. 60-71556 (Japanese Patent Laid-open Publication No. 61-229029) filed by the assignee of the present application.

Figure 1:
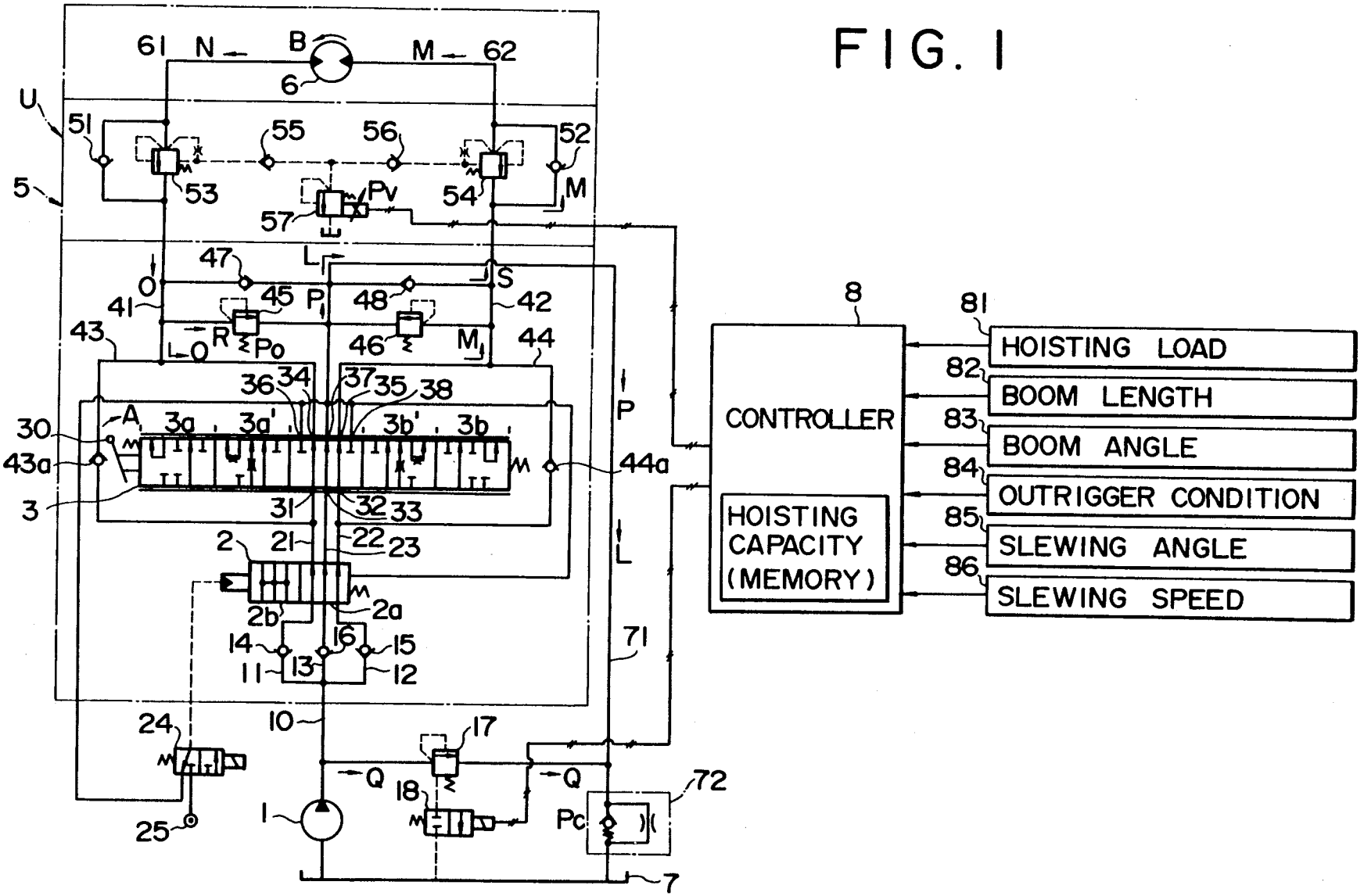
FIG. 1 is a hydraulic circuit diagram of a preferred embodiment of the present invention, showing a neutral brake mode.

Referring now to FIG. 1, a main circuit 10 is connected to a discharge opening of a hydraulic pump 1. An inlet port of a slewing unit U is connected to the main circuit 10, and a main relief valve 17 is also connected to the main circuit 10. There is provided in a vent circuit of the main relief valve 17 an electromagnetic selector valve (selecting means) 18 which can select either an on-load position where the vent circuit is blocked by the valve 18 to on-load the pump 1 or an unload position where the vent circuit is communicated with a tank 7 to unload the pump 1.

In the slewing unit U, first, second and third main passages 11, 12 and 13 are connected in parallel to each other in the inlet port, and check valves 14, 15 and 16 for preventing reverse flow to the pump 1 side are provided in the main passages 11, 12 and 13, respectively. A mode selecting valve 2 constructed by a pilot selector valve is operated by an electromagnetic selector valve 24 and an operating hydraulic power source 25 to select either a position 2*a*(neutral brake mode) where the main passages 11, 12 and 13 are individually communicated with first, second and third intermediate passages 21, 22 and 23, respectively or a position 2*b*(neutral free mode) where the main passages 11, 12 and 13 are all communicated with the intermediate passages 21, 22 and 23. The mode selecting valve 2 may be of a manual type or an electromagnetic type.

A direction selecting valve 3 is a manual selector valve having eight ports and three select positions, which is operated by an operating lever 30. The intermediate passages 21, 22 and 23 connected to first, second and third ports 31, 32 and 33 of the valve 3. A pair of passages 41 and 42 on a slewing motor 6 side are connected to fourth and fifth ports 34 and 35 of the valve 3. An oil return circuit 71 leading to the tank 7 is connected to sixth, seventh and eighth ports 36, 37 and 38 of the valve 3. Further, reference numerals 43 and 44 designate bypass passages provided with check valves 43*a* and 44*a*, respectively; reference numerals 45 and 46 designate overload relief valves; reference numerals 47 and 48 designate anti-cavitation check valves; and reference numeral 72 designates a back pressure valve.

Between the passages 41 and 42 and passages 61 and 62 connected to discharge and suction ports of the slewing motor 6, a pair of check valves 51 and 52 permitting flow from the direction selecting valve 3 to the slewing motor 6 are connected in parallel to a pair of main valves 53 and 54 constituting an electromagnetic proportional pressure control valve 5 for controlling a discharge oil pressure from the slewing motor 6 to the direction selecting valve 3, respectively. A common subvalve 57 constituting the electromagnetic proportional pressure control valve 5 is connected through check valves 55 and 56 to pressure control portions of the main valves 53 and 54, respectively. The main valves 53 and 54 and the subvalve 57 of the electromagnetic proportional pressure control valve 5 are constructed basically by a main valve and a subvalve of a balance piston type relief valve. The subvalve 57 is constructed by an electromagnetic porportional relief valve, and a downstream side of the subvalve 57 is connected to a drain.

Figure 3:
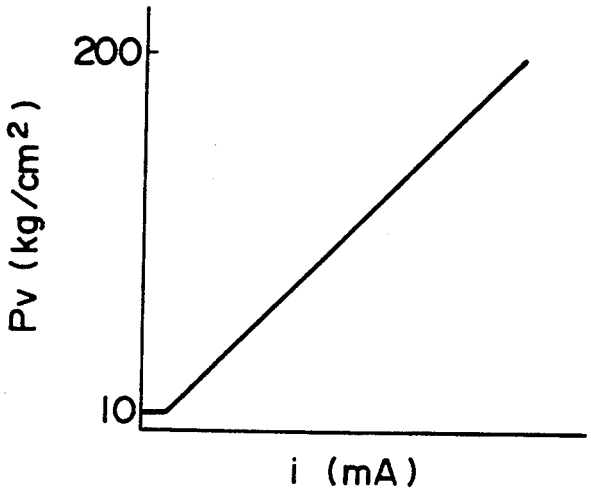
FIG. 3 is a control characteristic graph of the electromagnetic proportional pressure control valve according to the preferred embodiment.

A set pressure of the subvalve 57, that is, a set pressure Pv of the electromagnetic proportional pressure control valve 5 is controlled in the range of 10–200 $kg/cm^2$, for example, as shown in FIG. 3 according to a control signal (current i) from a controller (control means) 8. In this case, even when the signal i is zero, the set pressure Pv is maintained at a minimum value (10 $kg/cm^2$), so as to ensure the safety of operation. Further, a cracking preessure Pc of the back pressure valve 72 is set to a value (15 kg/cm$^2$, for example) greater than the control minimum value of the set pressure Pv in consideration of an inertial slewing operation in the neutral free mode which will be hereinafter described. Further, a set pressure Po of the overload relief valves 45 and 46 is set to a value (210 kg/cm$^2$, for example) greater than a control maximum value of the set pressure Pv.

The controller 8 inputs detection signals from detectors including a crane hoisting load detector 81, boom length detector 82, boom angle detector 83, outrigger expanded condition detector 84, slewing angle detector 85 and slewing speed detector 86. According to the detection signals and a preliminarily stored hoisting capacity, the controller 8 determines a slewing stop timing, and when the need of slewing stop is generated, the controller 8 outputs a select signal to the electromagnetic selector valve 18 and also outputs a control signal (current i) with a predetermined pattern to the subvalve 57 of the electromagnetic proportional pressure control valve 5. The number and the combination of the detectors are not limited to those of this preferred embodiment, but they may be changed and selected arbitrarily according to the kind of a crane or as desired.

The operation of the preferred embodiment will now be described.

I. Neutral Brake Mode

(a) Slewing Acceleration

When the lever 30 is operated in a direction depicted by an arrow A to select the direction selecting valve 3 toward a slewing position 3*a* under the condition where the electromagnetic valve 24 is unexcited to maintain the position 2*a* of the mode selecting valve 2 as shown in FIG. 1, a part of a discharge oil from the pump 1 is fed from the port 33 through a restriction (notch) of a spool to the port 37 under bleed-off control at a transient position 3*a*'of the direction selecting valve 3, and is then returned to the tank 7 in a direction depicted by an arrow L. On the other hand, the remaining discharge oil is fed through the ports 32 and 35 to the motor 6 in a direction depicted by an arrow M, thereby accelerating rotation of the motor 6 in a direction depicted by an arrow B.

At this acceleration, the discharge oil from the motor 6 is returned to the tank 7 in a direction depicted by arrows N, O and P. During normal slewing at this time, the signal to be output from the controller 8 to the subvalve 57 of the electromagnetic proportional pressure control valve 5 is zero to maintain the set pressure Pv at the control minimum value (10 kg/cm$^2$). Therefore, the discharge oil from the motor 6 passes lthe main valve 53 at the control minimum value to ensure smooth acceleration of rotation of the motor 6.

When an operational angle of the lever 40 is gradually increased, a flow amount from the pump 1 to the tank 7 is gradually decreased, and a flow amount from the pump 1 to the motor 6 is gradually increased. Thereafter, when the lever 30 is fully operated in the direction A to select the slewing position 3*a* of the direction selecting valve 3, the flow of pressure oil from the pump 1 to the tank 7 is blocked, and a maximum flow amount of pressure oil is supplied from the pump 1 to the motor 6. Therefore, the motor 6 is rotated at a speed corresponding to a spool stroke of the direction selecting valve 3, thus slewing a slewing body.

(b) Automatic Stop of Slewing

During the above slewing operation, the controller 8 determines whether the slewing body is in a safe area or in a dangerous area according to the detection signals from the detectors 81 to 86. When the slewing body is in the dangerous area or approaches it, the controller 8 outputs an automatic stop signal i. According to the signal i, the electromagnetic selector valve 18 is first excited to select a right position and accordingly communciate the vent circuit of the main relief valve 17 to the tank 7. As a result, the discharge oil from the pump 1 is unloaded to the tank 7 in a direction depicted by an arrow Q. Accordingly, even when the direction selecting valve 3 is selected to the slewing position 3*a*, a suction pressure (accelerating pressure) to the motor 6 is eliminated.

Then, according to the signal i from the controller 8, the set pressure Pv of the subvalve 57 of the electromagnetic proportional pressure control valve 5 is controlled as shown in FIG. 3. As a result, the pressure of the oil having been discharged from the motor 6 in the direction N is increased to a pressure corresponding to the set pressure Pv, thereby decelerating the motor 6 and braking the slewing body until stoppage thereof. At this time, a decelerating pressure of the motor 6 is controlled with a predetermined pattern (e.g., slow brake or quick brake) according to a slewing area or any other slewing operational conditions.

In the pressure control characteristic shown in FIG. 3, while the minimum value of the set pressure Pv is set to 10 kg/cm$^2$ for the purpose of ensuring control stability of the electromagnetic proportional pressure control valve 5, the set pressure Pc of the back pressure valve 72 is set to 15 kg/cm$^2$ even when the flow amount from the pump 1 is minimum. Therefore, when the signal i is zero, the control can be started under the condition where a pressure differential between the discharge side and the suction side of the motor 6 is 0 kg/cm$^2$. Accordingly, even in the case where fine control is required such that the boom is long, the pressure control can be carried out under a low pressure in a fine range.

(c) Manual Stop of Slewing (Neutral Brake)

When the operational position of the direction selecting valve 3 is returned from the slewing position 3*a* toward a neutral position after the acceleration of the motor 6, the discharge oil leading from the motor 6 in the direction O is returned through the direction selecting valve 3 to the tank 7, wherein the flow amount of the discharge oil is restricted by the restriction of the spool on a meter-out side. At this time, a part of the discharge oil from the motor 6 is allowed to flow from the passage 41 into the bypass passage 43. However, as the mode selecting valve 2 is in the position 2*a* in the neutral brake mode as shown in FIG. 1, the discharge oil having entered the bypass passage 43 is blocked by the check valve 14. Accordingly, only one passage leading from the port 34 to the port 36 is opened on the meter-out side. While the operational position of the direction selecting valve 3 is being returned from the slewing position 3*a* to the transient position 3*a*', the discharge oil from the motor 6 is restricted by the restriction on the meter-out side to be returned to the tank 7. Thus, the pressure in the passage 41 is controlled by such meter-out control, and the motor 6 is braked. On the other hand, a part of the discharge oil from the pump 1 is returned to the tank 7 in the direction L under bleed-off control, and simultaneously a required flow amount of the motor 6 is fed in the direction M to the motor 6.

Thereafter, when the operational position of the direction selecting valve 3 is fully returned to the neutral position, the restriction on the meter-out side is closed. Therefore, the discharge oil from the motor 6 is fed in a direction depicted by an arrow R, and is relieved through the overload relief valve 45 to the tank 7. As a result, a brake pressure corresponding to the set pressure Po of the relief valve 45 is applied to the motor 6, thereby rapidly stopping the motor 6, that is, the slewing body. On the other hand, the discharge oil from the pump 1 is returned in the direction L to the tank 7 under bleed-off control, and simultaneously a required amount of the oil is supplied through the anti-cavitation check valve 48 in a direction depicted by an arrow S to the suction side of the motor 6 until the motor 6 is stopped.

Meanwhile, under the automatic stop control of slewing as mentioned above in the section (b), when the operational position of the direction selecting valve 3 is returned from the slewing position 3*a* to the neutral position, the pressure in the passage 41 downstream of the main valve 53 of the electromagnetic proportional pressure control valve 5 is increased by the meter-out control of the direction selecting valve 3. However, since the downstream side of the subvalve 57 is connected to the drain, and the set pressure Pv is accordingly controlled in an absolute pressure fashion rather than a differential pressure fashion, the set pressure Pv is not influenced by the pressure in the passage 41 downstream of the main valve 53, but it is properly controlled according to the signal i from the controller 8. Thus, the automatic stop control of slewing is properly carried out according to the signal i from the controller 8.

However, in the case where an operator notices a danger to return the lever 30 to the neutral position at once under the automatic stop control, the pressure in the passage 41 subjected to the meter-out control of the direction selecting valve 3 is increased to a value higher than the set pressure Pv of the subvalve 57 controlled by the signal i from the controller 8, and the motor 6 is braked by the higher pressure, that is, the meter-out controlled pressure. Thus, even under the automatic control, the operator can interrupt the automatic control to preferentially effect the manual control for emergency stop.

II. Netural Free Mode

(a) Slewing Acceleration

Figure 2:
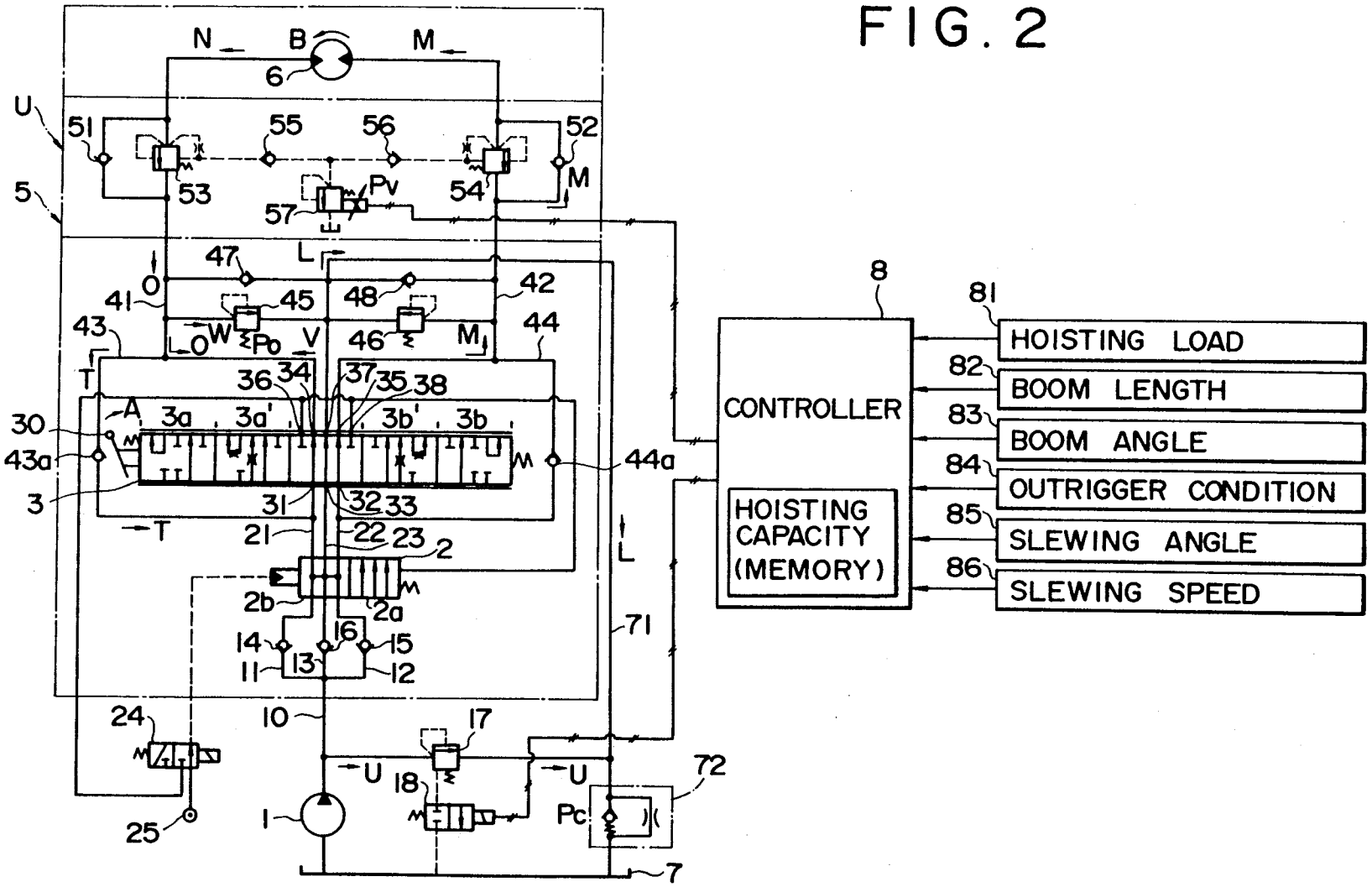
FIG. 2 is a view similar to FIG. 1, showing a neutral free mode.

As shown in FIG. 2, when the electromagnetic selector valve 24 is excited to select its right position, the hydraulic oil is supplied from the operating hydraulic power source 25 to a pilot portion of the mode selecting valve 2 to select the left position 2*b* of the mode selecting valve 2. Under the condition, when the lever 30 is operated in the direction A to select the slewing position 3*a* of the direction selecting valve 3, the motor 6 is acceleratively rotated in the direction B to slew the slewing body in substantially the same manner as at the acceleration in the neutral brake mode as mentioned previously in the section I-(a).

(b) Inertial Slewing

After acceleration of rotation of the motor 6, when the direction selecting valve 3 is returned from the slewing position 3*a* to the neutral position, the motor 6 continues to be rotated by inertia in the direction B. Accordingly, the discharge oil from the motor 6 is fed in the direction N to the main valve 53 of the electromagnetic proportional pressure control valve 5. At this time, as the set pressure Pv is maintained at the control minimum value, no braking operation by the electromagnetic proportional pressure control valve 5 is effected, and the discharge oil from the motor 6 passes the main valve 53 to be fed in the direction O.

At the transient position 3*a*′ of the direction selecting valve 3, the discharge oil fed from the motor 6 in the direction O is returned through the port 34 and the port 36 to the tank 7, wherein a flow amount is restricted by the restriction of the spool. At this time, however, a part of the discharge oil is fed in a direction depicted by an arrow T through the bypass passage 43 and the left position of the mode selecting valve 2 to the port 33, thereafter being returned through the port 37 to the tank 7. Accordingly, even when the direction selecting valve 3 is returned from the slewing position 3*a* to the transient position 3*a*′, the total flow amount on the meter-out side is not restricted. Further, the set pressure Pv of the subvalve 57 is maintained at the control minimum value, and the cracking pressure Pc of the back pressure valve 72 is set at a value greater than the control minimum value, which increases a general system pressure. Therefore, no undue back pressure (brake pressure) by the main valve 53 and the subvalve 57 is applied to the discharge side of the motor 6, thus ensuring smooth inertial rotation of the motor 6. On the other hand, the remaining part of the discharge oil fed from the pump 1 through the ports 33 and 37 to the tank 7 under bleed-off control and a part of the discharge oil from the motor 6 fed in the direction T are fed in the direction M to the suction side of the motor 6. Therefore, the motor 6 is continuously smoothly rotated by inertia in the direction B.

Thereafter, when the direction selecting valve 3 is returned from the transient position 3*a*′ to the neutral position, all the ports 31 to 38 of the direction selecting valve 3 are communicated with each other through the left position 2*b* of the mode selecting valve 2. Accordingly, the discharge oil from the pump 1 is fed in the direction L to be bled off to the tank 7, and no driving pressure is generated on the suction side of the motor 6. However, as the motor 6 continues to be rotated by inertia, the discharge oil from the motor 6 fed in the directions N and O is allowed to flow through the neutral position of the direction selecting valve 3 and the left position of the mode selecting valve 2 and in the direction M to the suction side of the motor 6. Accordingly, the motor 6 is not stopped at once, but is rotated by inertia to effect the inertial slewing, thereafter the slewing body being gradually stopped by an external force such as by wind and a line resistance to the oil.

(c) Automatic Stop of Slewing

During the slewing acceleration and the inertial slewing, when the automatic stop signal i is output from the controller 8, the electromagnetic selector valve 18 is selected to its right position to unload the discharge oil from the pump 1 in a direction depicted by an arrow U to the tank 7 and simultaneously control the set pressure Pv of the electromagnetic proportional pressure control valve 5 as shown in FIG. 3 by the operation similar to the automatic stop operation in the neutral brake mode. Accordingly, even when the direction selecting valve 3 is maintained in the slewing position 3*a*, the discharge pressure of the pump 1, i.e., the accelerating pressure of the motor 6 is substantially zero, and the discharge oil pressure (decelerating pressure) of the motor 6 is increased to brake the motor 6.

(d) Manual Stop of Slewing (Counter Lever)

During the inertial slewing as mentioned in the section (b), when the slewing body, that is, the motor 6 is intended to be rapidly stopped, the lever 30 is operated in a direction counter to the direction A (counter lever operation) to select a position 3*b* via a position 3*b'* of the direction selecting valve 3. At the transient position 3*b'* of the direction selecting valve 3, a part of the discharge oil from the pump 1 is bled off through the port 33, the restriction of the spool and the port 37 to the tank 7, while the remaining oil is fed through the ports 31 and 34 in a direction depicted by an arrow V to enter the passages 41 and 61 on the discharge side of the motor 6 and force back the discharge oil from the motor 6 fed in the directions N and O. Accordingly, a reverse rotating force is applied to the motor 6 to thereby brake the motor 6. At this time, the oil having entered the passage 41 is fed in a direction depicted by an arrow W and is relieved through the overload relief valve 45 to the tank 7. Thus, the brake pressure can be controlled by selecting the position 3*b'* of the direction selecting valve 3 by the counter lever operation. Furthermore, when the position 3*b* is selected, a maximum brake pressure can be exhibited. In this manner, the motor 6 can be braked by a brake pressure corresponding to a counter lever stroke.

Meanwhile, during the automatic stop operation as mentioned in the section (c), when the operator notices a danger to carry out the counter lever operation as mentioned in the section (d) so that the flow amount in the direction V from the pump 1 may be increased to make the pressure in the passage 41 higher than the set pressure Pv of the electromagnetic proportional pressure control valve 5, the motor 6 can be braked by the manual operation (counter lever operation) in the same manner as that in the neutral brake mode. Thus, even under the automatic control, the operator can interrupt the automatic control to preferentially effect the manual control for emergency stop.

Figure 4:
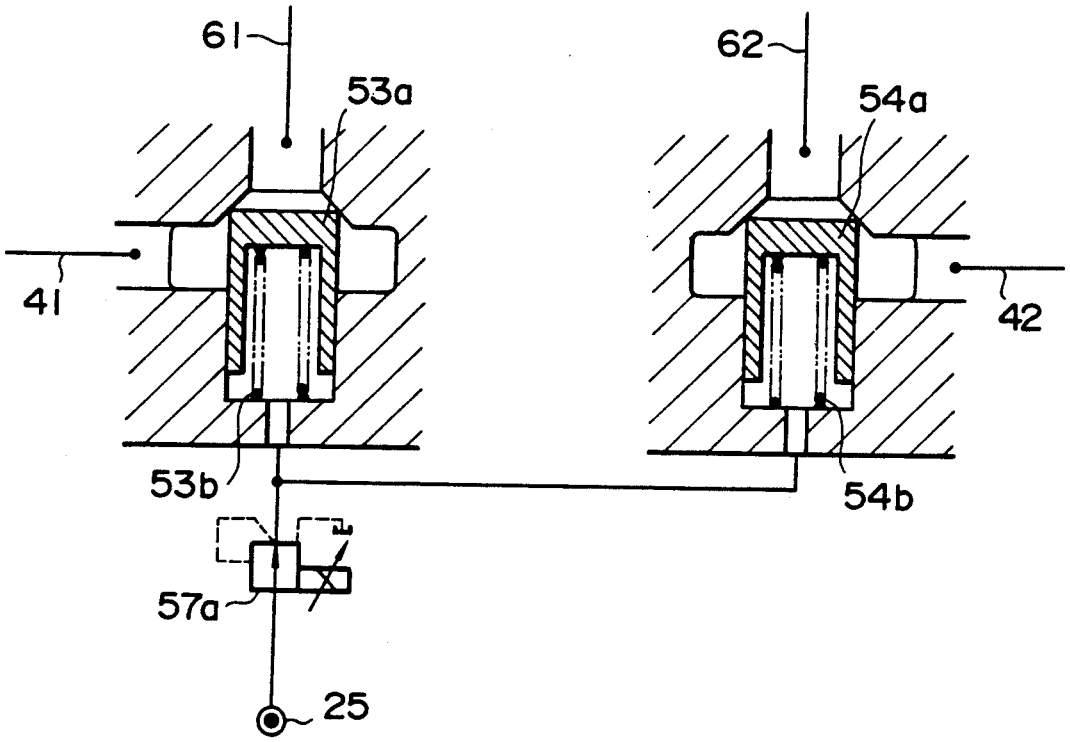
FIG. 4 is a hydraulic circuit diagram of an essential part of the electromagnetic proportional pressure control valve according to another preferred embodiment.

Although the electromagnetic proportional pressure control valve 5 in the above preferred embodiment is constructed of the main valves 53 and 54 and the subvalve 57 of a balance piston type relief valve, it may be constructed by a poppet valve as shown in FIG. 4. Referring to FIG. 4, a secondary side of an electromagnetic proportional pressure reducing valve 57*a* is connected to oil chambers of poppets 53*a* and 54*a* where springs 53*b* and 54*b* are located, respectively, while a primary side of the valve 57*a* is connected to an operating hydraulic pressure source 25. A secondary pressure of the electromagnetic proportional pressure reducing valve 57*a* is controlled by the signal i from the controller 8 to thereby control a set pressure of the poppet valve and control the pressure on the discharge side of the motor 6. With this construction, oil leakage may be eliminated as compared with the preferred embodiment shown in FIGS. 1 and 2. Furthermore, a difference between an outer diameter of each of the poppets 53*a* and 54*a* and a seat diameter is eliminated. Therefore, the set pressure may be accurately controlled without the influence of the pressure in the passages 41 and 42 downstream of the poppet valve.

The device of the present invention may be, of course, applied to a neutral brake dedicated type and a neutral free dedicated type.

As described above, when the need of stopping the slewing body is generated during the slewing operation, a control signal is input to the electromagnetic proportional pressure control valve to control the set pressure thereof. Then, the pressure on the discharge side of the motor is controlled according to the set pressure so as to automatically brake the motor and rapidly brake the slewing. Further, even under the automatic control, the operator can interrupt the automatic control to preferentially effect a manual control for emergency stop, thus improving the operability and the safety. Further, the device of the present invention can be applied to both the neutral brake system and the neutral free system, and the automatic stop of slewing can be effected in both the systems. Thus, a general-purpose performance of the device can be improved.

While the invention has been described with reference to specific embodiments, the description is illustrative and is not to be construed as limiting the scope of the invention. Various modifications and changes may occur to those skilled in the art without departing from the spirit and scope of the invention as defined by the appended claims.

What is claimed is:

1. A slewing control device for a crane for supplying a discharge oil from a pump through a direction selecting valve to a slewing motor and for controlling a rotational direction of said slewing motor, said slewing control device comprising:

a main circuit including select means provided between said pump and said direction selecting valve, said select means selecting either an unload condition of said pump where a hydraulic oil in said main circuit is communicated with a tank or an on-load condition of said pump where communication between said main circuit and said tank is blocked;

a first check valve provided between said direction selecting valve and a suction port of said slewing motor;

a second check valve provided between said direction selecting valve and a discharge port of said slewing motor, said first and second check valves permitting flow of said hydraulic oil from said direction selecting valve to said slewing motor;

a first electromagnetic proportional pressure control valve provided between said direction selecting valve and said suction port of said slewing motor in parallel with said first check valve;

a second electromagnetic proportional pressure control valve provided between said direction selecting valve and said discharge port of said slewing motor in parallel with said second check valve, said first and second electromagnetic proportional pressure control valves controlling pressure of oil discharged from said slewing motor to said direction selecting valve; and control means for outputting a select signal to said select means to select said unload condition and also for outputting a pressure control signal to said second electromagnetic proportional pressure control valve between said direction selecting valve and said discharge port to control oil pressure on a discharge side of said slewing motor to stop rotation of said slewing motor.

2. The slewing control device as defined in claim 1, further comprising:

a back pressure valve provided in an oil return circuit communicating said direction selecting valve with said tank, wherein a cracking pressure of said back pressure valve is set to a value higher than a minimum set pressure of said first and second electromagnetic proportional pressure control valves.

* * * * *